US006394004B1

(12) United States Patent
Lynn

(10) Patent No.: US 6,394,004 B1
(45) Date of Patent: May 28, 2002

(54) COMMUNION TRAY ASSEMBLY AND COMMUNION TRAY

(75) Inventor: Alex R. Lynn, Lewisville, TX (US)

(73) Assignee: DFW International Church of Christ, Carrollton, TX (US)

( * ) Notice: Subject to any disclaimer, the term of this patent is extended or adjusted under 35 U.S.C. 154(b) by 0 days.

(21) Appl. No.: 09/564,921

(22) Filed: May 4, 2000

(51) Int. Cl.[7] ..... A47B 7/00
(52) U.S. Cl. ..... 108/91; 108/53.3; 211/126.7
(58) Field of Search ..... 108/91, 92, 53.1, 108/53.3, 53.5; 211/41.1, 41.2, 126.1, 126.7, 126.12, 128.1

(56) References Cited

U.S. PATENT DOCUMENTS

RE19,813 E * 1/1936 Steudel ..... 108/91
2,704,974 A * 3/1955 Setman
2,871,536 A * 2/1959 Childress ..... 108/53.3 X
RE24,731 E * 11/1959 Lockwood
3,196,909 A * 7/1965 Monk
3,768,710 A * 10/1973 Eggers
4,457,432 A * 7/1984 Solheim
5,074,223 A * 12/1991 Remmers ..... 108/91
5,934,486 A * 8/1999 Jarvis et al.

* cited by examiner

*Primary Examiner*—Jose V. Chen
(74) *Attorney, Agent, or Firm*—F. Lindsey Scott

(57) ABSTRACT

An easily fabricated communion tray and an assembly for using the communion tray in an assembly for large groups of participants.

7 Claims, 4 Drawing Sheets

COMMUNION TRAY ASSEMBLY AND COMMUNION TRAY

FIELD OF THE INVENTION

This invention relates to an easily fabricated communion tray and an assembly for using the communion tray in an assembly for large groups of participants.

BACKGROUND OF THE INVENTION

In many religious observances, small communion glasses of wine, grape juice or the like and small quantities of bread are distributed to the participants. A wide variety of communion trays are used for distributing the small communion glasses to the participants. Many of these communion trays are round and are fabricated to be attractive and durable. Unfortunately, many of these communion trays are quite expensive since they are fabricated as relatively shallow round pan-like containers which include inside the container a planar surface which includes a plurality of communion glass holder openings. While these trays have been effective and are used widely, they are relatively expensive.

In many instances, it is desirable to be able to produce communion trays and communion tray assemblies very economically for use with very large assembled groups for special occasions. In such instances, it is desirable that the communion tray assemblies be of a cost such that they can be readily produced and used in large quantities and possibly discarded after only a single use.

Accordingly a continuing effort has been directed to the development of a communion tray and a communion tray assembly, which is economical, yet effective, to distribute communion glasses to participants.

SUMMARY OF THE INVENTION

According to the present invention, an economical communion tray is provided and comprises a generally horizontal planar member having a first and a second end, a plurality of communion glass holder openings positioned through the planar member, a plurality of tab receptacles positioned in the planar member, a support member positioned at each of the ends of the planar member to extend downwardly from each end of the planar member, a handle positioned at each end of the planar member and tabs positioned on a lower end of at least a portion of the support members and positioned to engage tab receptacles in one of a base or a second tray.

Further the communion tray is readily used in a communion tray assembly comprising a base having an upper surface with a plurality of tab receptacles formed in its upper surface; at least one communion tray comprising a generally horizontal planar member having a first and a second end, a plurality of communion glass holder openings positioned through the planar member, a plurality of tab receptacles positioned in the planar member, a support member positioned at each of the ends of the planar member to extend downwardly from each end of the planar member, a handle positioned at each end of the planar member and tabs positioned on a lower end of at least a portion of the support members and positioned to engage tab receptacles in one of the base or of a second communion tray.

The assembly may also include a cover comprising a horizontal cover planar member having a first end and a second end, a cover support member positioned at each of the ends of the cover planar member to extend downwardly from each of the ends of the cover planar member and tabs positioned on a lower end of at least a portion of the cover support members and positioned to engage tab receptacles in one of a base or a communion tray.

The communion tray and the communion tray cover are readily fabricated by configuring a planar section of a suitable material to include the receptacles and communion glass holder openings and the support members with the support members then being bent to extend downwardly from the ends of the planar member.

DESCRIPTION OF PREFERRED EMBODIMENTS

In the discussion of the figures, the same numbers will be used throughout to refer to the same or similar components.

Figure 1:
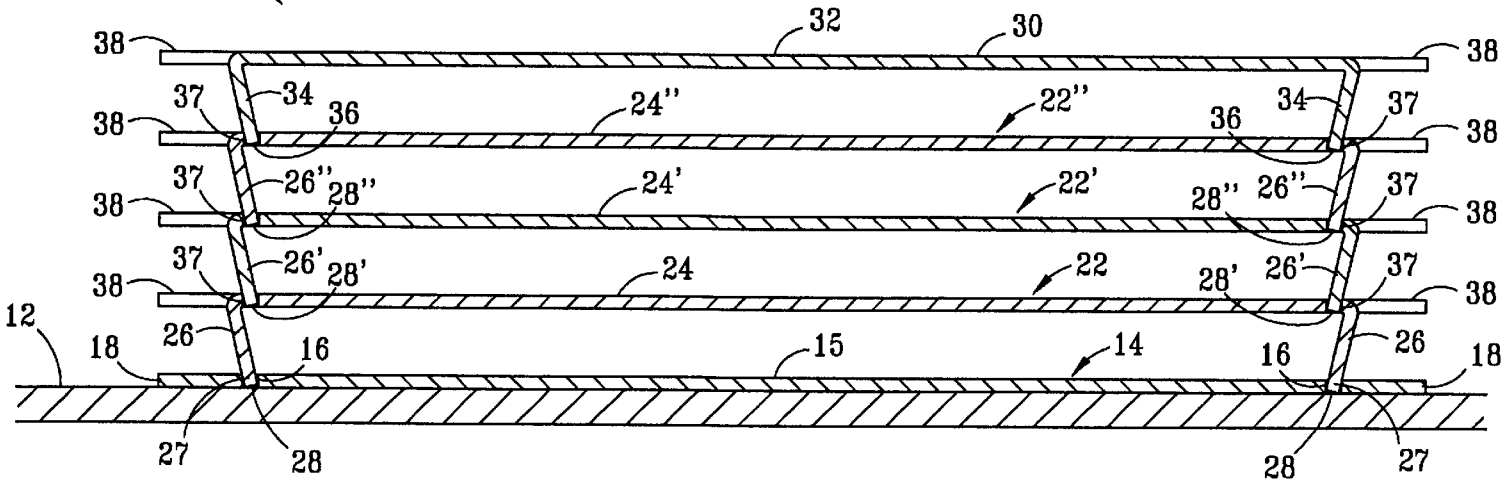
FIG. 1 is a cross-sectional view of a communion tray assembly taken through the tabs on the support members.

In FIG. 1, a communion tray assembly 10 according to the present invention is shown. The communion tray assembly is positioned on a surface 12, which may be a table, or other flat surface as convenient. The assembly comprises a base 14 having an upper surface 15 and a plurality of base receptacles 16, which as shown extend through base 14, but which may extend into base 14 to a lesser depth. Base 14 has ends 18 and sides 20.

A plurality of communion trays 22, 22' and 22" are shown positioned on base 14. The communion trays are substantially identical to each other and have been numbered using numbers with prime and double-prime designations to refer to the three communion trays shown in FIG. 1. Tray 22 will be described with it being understood that the remaining trays are substantially identical. Tray 22 comprises a planar member 24 having a first end 23 and a second end 25. Planar member 24 is supported by supports 26, which are positioned to extend downwardly from planar member, 24 and which include tabs 28 on lower ends 27 of supports 26. Tabs 28 are configured to and are positioned to matingly engage base receptacles 16 in base 14. The engagement of tabs 28 with base receptacle 16 maintains tray 22 in position as the tray assembly is carried by a clergyman, an usher or other server or passed along a row of participants or the like.

While not shown in FIG. 1, planar member 24 includes a plurality of communion glass holder openings to retain a plurality of communion glasses in position on planar member 24 for service to worship participants. As indicated, communion trays 22' and 22" are substantially identical and will contain additional glasses of liquid for participants in a worship service. These trays are also held in position by tabs on the bottom of their respective supports. The supports are of a length to support each of the trays a sufficient distance above the tray beneath it so that space is provided for communion glasses for each surface 24, 24' and 24". The legs are also positioned so that the tabs readily engage receptacles 16 or communion tray receptacles 37 positioned on each of the communion trays so that tabs from the tray above each tray engage communion tray receptacles in the tray immediately beneath it so that the trays are retained in position. The assembly may include a single communion tray or more than three communion trays as desired.

A cover 30 is positioned above top communion tray 24". The cover comprises a planar member 32 and supports 34, which include tabs 36, which are positioned in communion tray receptacles 37 on the top communion tray. This receptacle and tab arrangement serves to maintain cover 30 in position on the communion tray assembly.

As shown in FIG. 1, both cover 30 and each of the communion trays 22 include handles 38 on each end. The use of such handles is optional although it is believed that it will be highly preferred to include such handles on the communion trays, but it may not be as desirable to include the handles on cover 30.

It is also noted that while base 14, as shown, is substantially the same length as the communion trays, it may be desirable in many instances to extend the ends of the base beyond the ends of communion trays 22. Similarly, it may be desirable to extend the sides of base 14 beyond the width of the communion trays.

Figure 2:
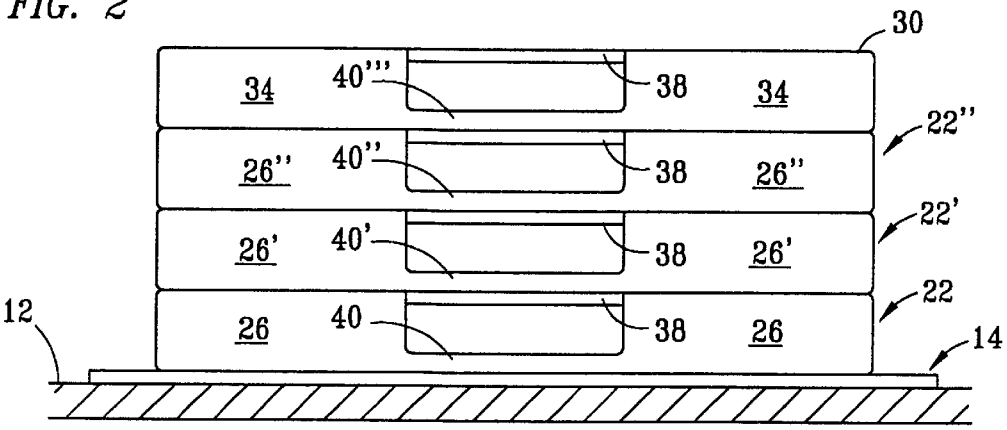
FIG. 2 is an end view of the communion tray assembly shown in FIG. 1.

In FIG. 2, an end view of the communion tray assembly shown in FIG. 1 is shown. In this embodiment the support members 26, 26', 26" and 34 are shown as planar members extending downwardly from planar members 24, 24', 24" and 32. A member 40 is shown as member 40, 40', 40" and 40'" extending between supports 26 and 34 beneath handles 38. This strip is optional and may be omitted. As will be discussed subsequently in the method for fabricating the communion trays it is desirable that the trays be formed of a single planar sheet which is configured to contain the necessary openings and material for the supports, with the supports then being formed by bending the support members into place beneath the respective planar surfaces.

Figure 3:
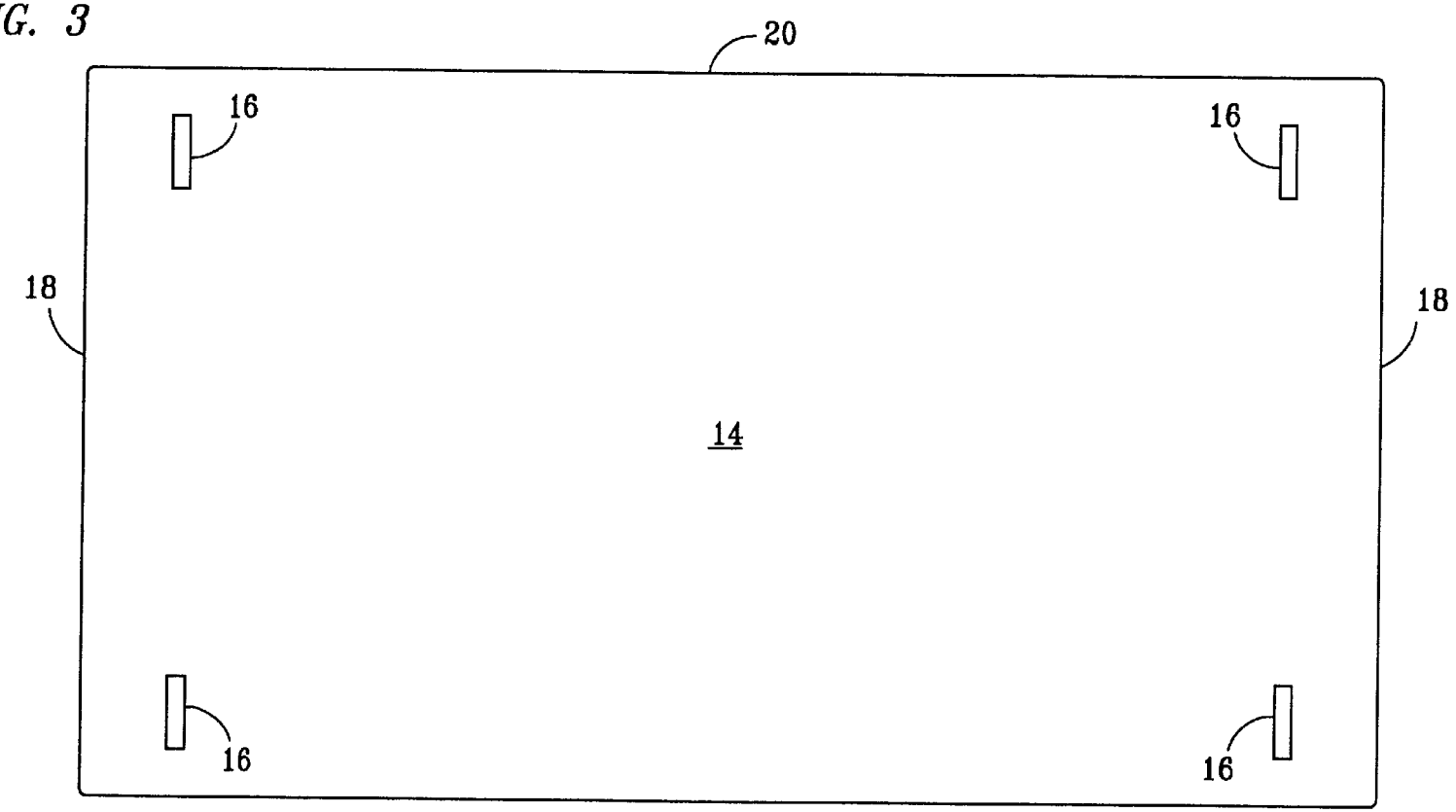
FIG. 3 is a top view of a communion tray assembly base.

In FIG. 3 a top view of base 14 is shown. Base 14 includes four base tab receptacles 16 positioned to receive tabs from communion trays positioned on base 14.

Figure 4:
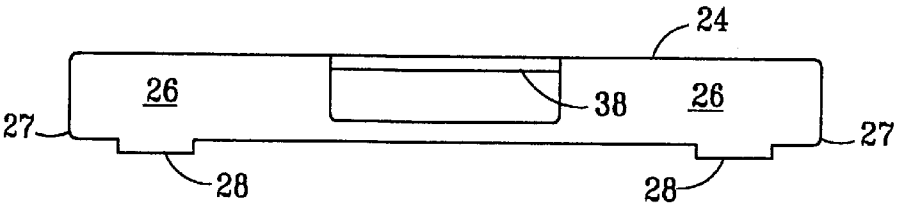
FIG. 4 is an end view of a communion tray according to the present invention.

In FIG. 4 an end view a communion tray is shown. In this view the tabs 28 are shown positioned on lower ends 27 of supports 26. A handle 38 is shown in this embodiment, but no strip 40 is included.

Figure 5:
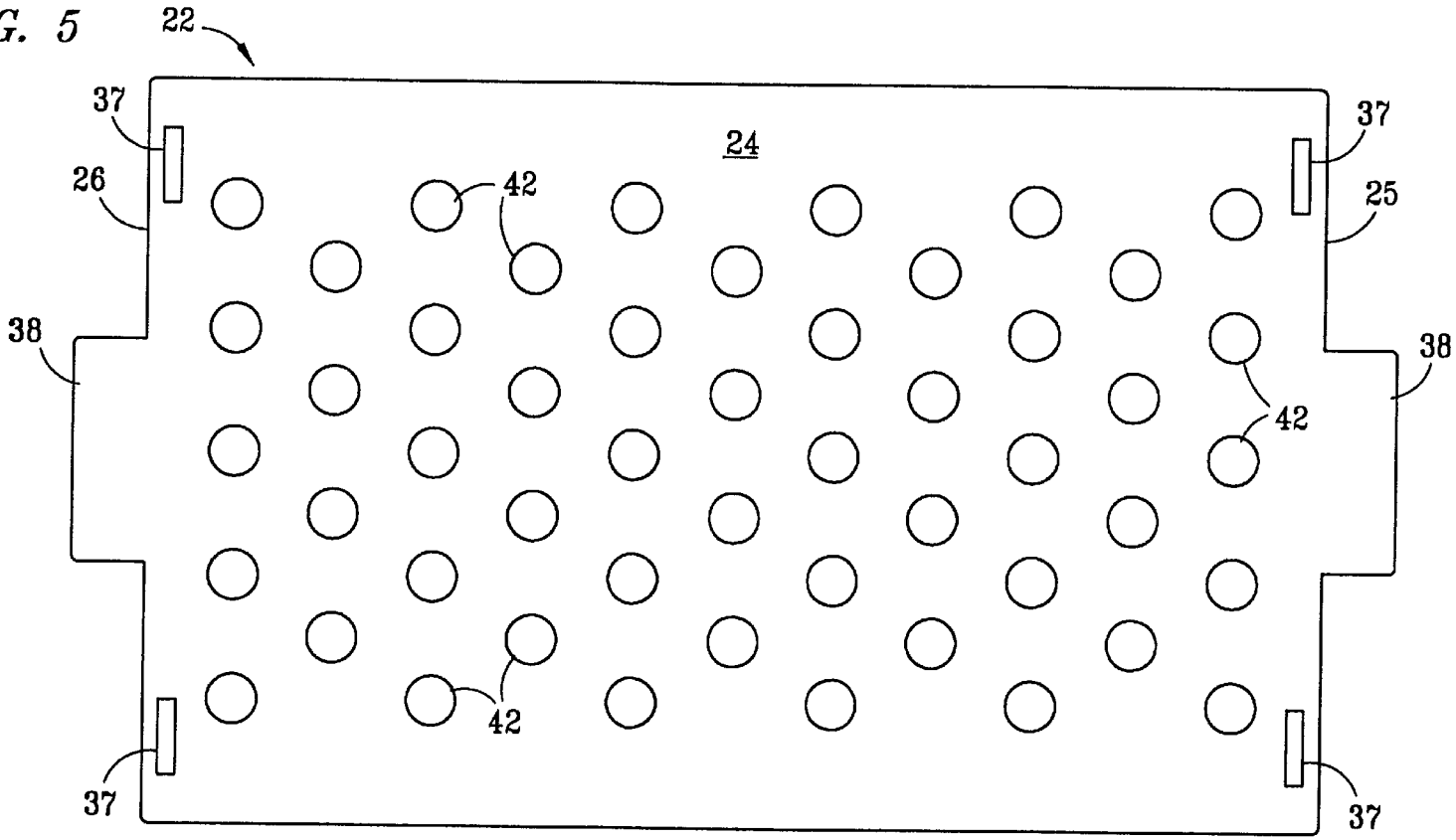
FIG. 5 is a top view of a communion tray according to the present invention.

FIG. 5 shows a top view of the communion tray shown in FIG. 4. In this view, communion glass holders 42 are shown as a plurality of openings positioned in planar member 24. In the embodiments shown, handles 38 are included at each of a first end 25 and a second end 26 of communion tray 22. Communion tray tab receptacles 37 are also shown for receiving tabs from a communion tray positioned above the communion tray shown in FIG. 5 or for a cover positioned above the communion tray shown in FIG. 5.

Figure 6:
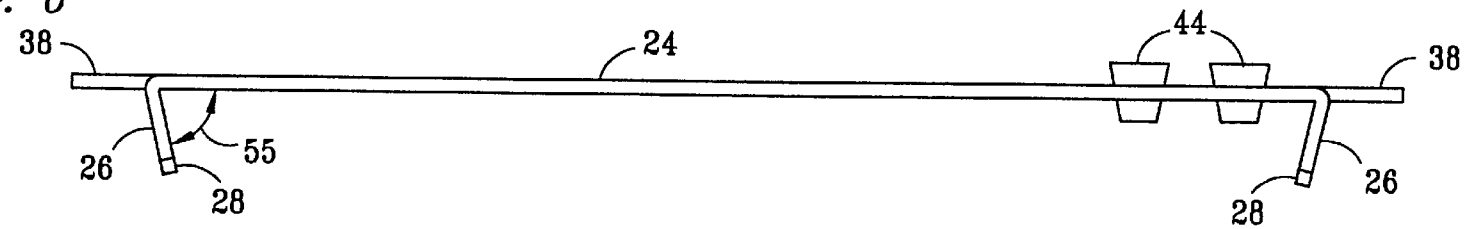
FIG. 6 is a side view of the communion tray shown in FIG. 5.

FIG. 6 shows a side view of the communion tray shown in FIG. 5. In this view, supports 26 are shown. Supports 26 are desirably of the same material comprising planar surface 24 and are bent into the positions shown. Supports 26 are positioned at an angle 55 formed by the intersection of an inside of support 26 with a bottom of planar surface 24. This angle is desirably about 70 to about 80 and preferably about 75 to about 78 degrees but considerable variation is possible so long as the support does not interfere with the positioning of the communion glasses or the positioning of the tabs. A tab 28 is positioned on the lower end of each support 26 and is positioned to matingly engage a receptacle in a base or another communion tray. In this fashion, the communion trays are readily stackable for carrying, storage or the like. Two illustrative communion glasses 44 have been shown positioned in communion glass holders 42 in planar member 24.

Figure 7:
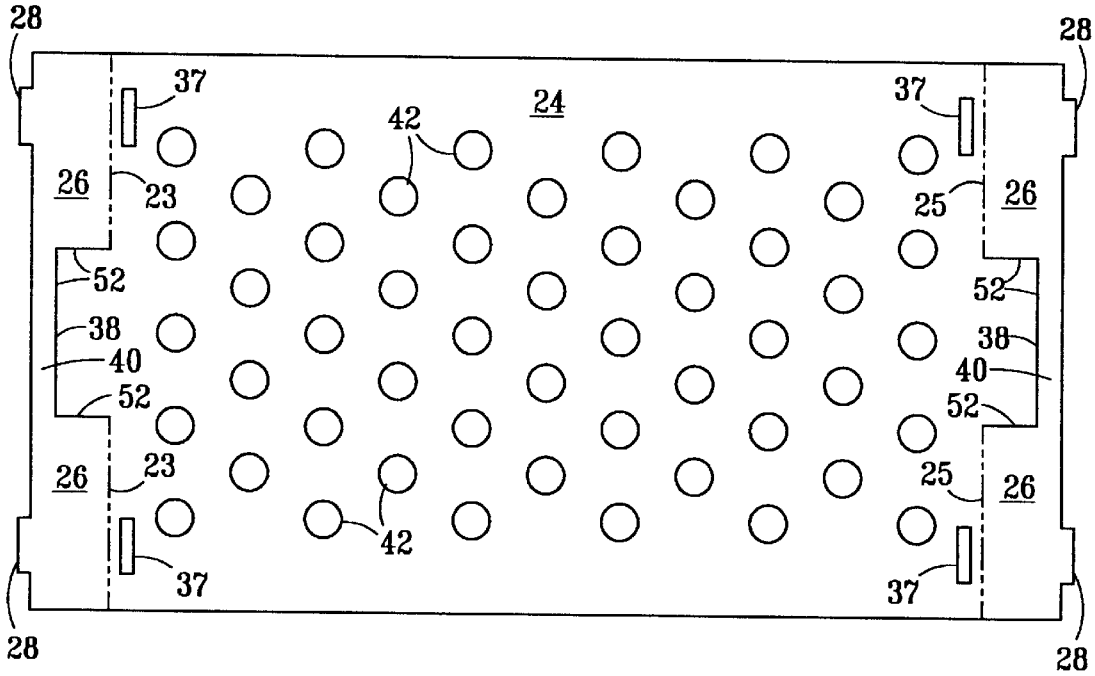
FIG. 7 is a section of planar material configured for the formation a communion tray according to the present invention.

In FIG. 7, a piece of material has been configured by forming openings defining communion tray tab receptacles 37 and openings have been formed to define communion glass holders 42. A suitable cut 52 has been made defining the outside contour of handles 38. As configured the sheet of material shown in FIG. 7 is readily formed into a communion tray by simply bending supports 26, including strip 40, downwardly into a proper orientation beneath the top surface of planar member 24. This readily accomplished by conventional forming techniques with many commonly used materials.

Figure 8:
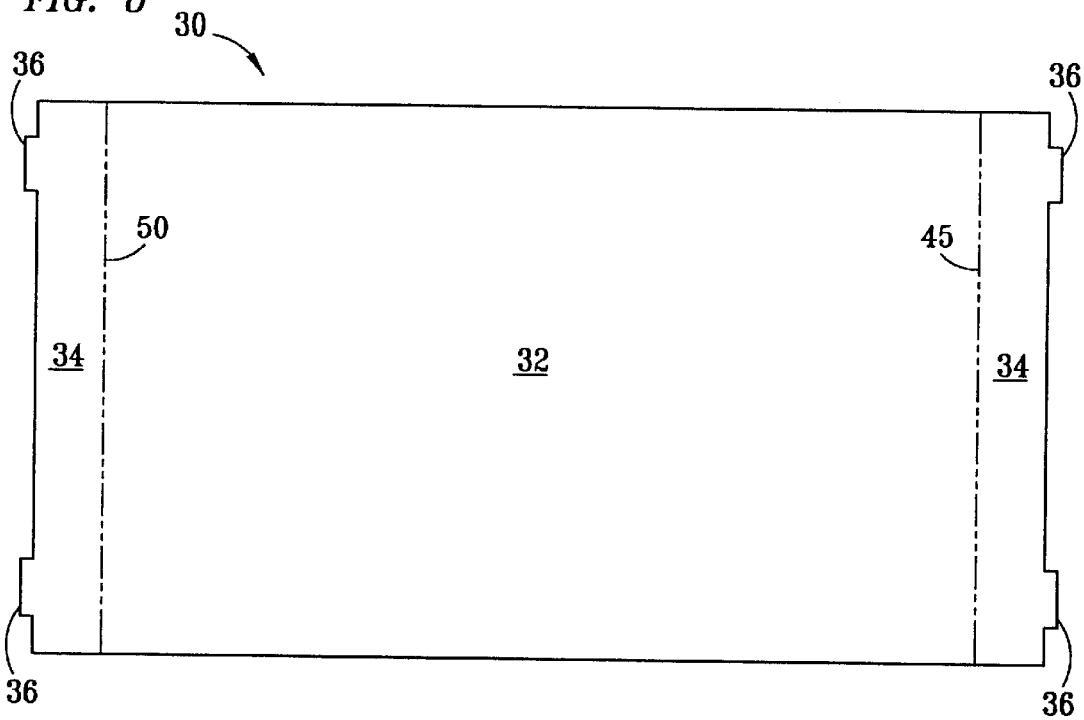
FIG. 8 is a section of a planar material configured to form a cover for a communion tray according to the present invention.

In FIG. 8, a sheet of material formed for use in producing a cover is shown. With the material configured to this shape, bending the support members 34 downwardly from the ends 48 and 50 of planar member 32 results in the production of a communion tray cover.

According to the present invention, the communion trays, base and covers are all readily formed from flat sheet stock, which is readily available. The materials available in this fashion are relatively economical and can be used to produce communion trays and communion tray assemblies at a relatively low cost. The communion trays, bases and covers may be produced of relatively heavy paper stock. They may also be formed of various plastic stocks. It may be necessary in such instances to use heating with the forming step for the supports. They may also be formed of relatively thin metal stock. The material is selected to be a material having sufficient strength to bear the weight of the filled communion glasses safely and resist undue bending and twisting as the trays are used by participants or as they are carried by ministers, ushers or other servers.

A particularly suitable material has been found to be aluminum. Aluminum is readily available in relatively thin sheets and has relatively good strength while being readily formable. Particularly desirable results have been achieved by using aluminum sheets from about 0.075 to about 0.125 inches and preferably about 0.090 inches in thickness. This thickness of aluminum is readily formable and yet provides suitable strength to support the filled communion glasses in the communion trays. Of course, other thicknesses could be used as desired for greater strength, reduced weight and the like.

When other materials are used, suitable thickness must be selected to support the filled communion glasses and the communion tray. Other materials may be desirable, particularly when it is necessary to produce communion trays in large numbers for use in applications in which they may be discarded after a single use. The present invention is well adapted to the production of such trays in mass quantities.

The present invention is also adapted to the production of communion trays, which may include ornamental or decorative finishes on their surfaces, especially when fabricated of metal or plastic. For instance, the communion trays can be plated, anodized, polished, painted, powder-coated, buffed to a matte surface, and the like, as known to those skilled in the art, to provide a pleasing surface.

While it has not been discussed in detail, the edges of openings and the edges of planar members and the like are desirably rounded, ground or otherwise treated to eliminate rough edges, which may cut or snag individual's clothing or the like.

The various techniques used to form materials after configuration into a desired configuration are considered to be well known to those skilled in the art.

Similarly methods of cutting, profiling, drilling and otherwise forming openings and cuts as necessary to produce the configurations required are considered to be known to those skilled in the art. Further the positioning of the tab receptacles in the communion trays and bases is such that the tab receptacles are not sufficiently near the ends of the planar surfaces so that the receptacles tend to tear out at the ends of the planar members or the like. Further the supports are positioned so that the tabs readily engage the tab receptacles which are desirably sized to be just slightly larger than the tabs on the supports so that the tabs readily engage the receptacles. The receptacles, however, are not sufficiently large so that slippage of the tabs in the receptacles occurs to any substantial extend during the handling and use of the communion tray assembly. Further, the number of communion glass holders 42 per tray may be varied over a wide range and may be selected for a specific event, a specific congregation or the like.

Having thus described the present invention by reference to its preferred embodiments, it is noted that the embodiments described are illustrative rather than limiting in nature and that many variations and modification are possible within the scope of the present invention. Many such variations and modifications may be considered obvious and desirable by those skilled in the based upon a review of the foregoing description of preferred embodiments.

Having thus described the invention, I claim:

1. A communion tray comprising;

a) a base having an upper planar surface, a plurality of tab receptacles formed in the planar upper surface; and b) at least one communion tray comprising a generally horizontal cover planar member having a first and a second end, a plurality of communion glass holder openings positioned through the horizontal planar member, a plurality of tab receptacles positioned in the planar member, a at least one planar support member fixedly positioned to support each of the ends of the horizontal planar member and extending downwardly from each end of the horizontal planar member, a handle positioned at each of the horizontal planar member and tabs positioned on a lower end of at least a portion of the planar support members and positioned to engage tab receptacles in one of a planar surface of a base or a second communion tray.

2. The assembly of claim 1 wherein the assembly comprises a plurality of communion trays.

3. The assembly of claim 1 wherein the assembly includes a cover comprising a horizontal cover, a generally horizontal cover planar member having a first end and a second end, at least one planar cover support member fixedly positioned to support each of the ends and extending downwardly from each of the ends of the cover planar member and tabs positioned on a lower end of at least a portion of the planar cover support member and tabs positioned to engage tab receptacles in one of the base of a communion tray.

4. The assembly of claim 3 wherein the cover includes a handle on each end.

5. The assembly of claim 1 wherein the planar support members are positioned to extend downwardly from the horizontal planar member to form an inside angle from about 70 to about 80 degrees.

6. A communion tray comprising;

a) at least one communion tray comprising a generally horizontal planar member having a first and a second end, a plurality of communion glass holder openings positioned through the horizontal planar member, a plurality of tab receptacles positioned in the planar member, at least one planar support member fixedly positioned to support each of the ends of the horizontal planar member and extending downwardly from each end of the horizontal planar member, a handle positioned at each end of the horizontal planar member and tabs positioned on a lower end of at least a portion of the planar support members and positioned to engage tab receptacles in one of a base or a horizontal planar member of a second communion tray.

7. A method for fabricating a communion tray comprising;

a) at least one communion tray comprising a generally horizontal planar member having a first and a second end, a plurality of communion glass holder openings positioned through the horizontal planar member, a plurality of tab receptacles positioned in the horizontal planar member, at least one planar support member positioned to support each of the ends of the horizontal planar member and extending downwardly from each end of the horizontal planar member, a handle positioned at each end of the horizontal planar member and tabs positioned on a lower end of at least a portion of the planar support members and positioned to engage tab receptacles in one of a base or a planar surface of a second communion tray; or b) a communion tray server comprising a horizontal planar member having a first and a second end, a plurality of communion glass holder openings positioned through the planar member, a plurality of tab receptacles positioned in the horizontal planar member, at least one planar support member positioned to support each of the ends of the horizontal planar member and extending downwardly from each end of the horizontal planar member, a handle positioned at each end of the horizontal planar member and tabs positioned on a lower end of at least a portion of the planar support members and positioned to engage tab receptacles in one of a planar horizontal member of a communion tray assembly base or a planar horizontal member of a second communion tray, the method comprising configuring a planar section of a suitable material to include at least one of the tab receptacles, communion glass holder openings, and the support member and bending the support members to extend downwardly from the ends of the planar member to form the cover and the communion trays.

* * * * *